US009057525B2

(12) United States Patent
Braden et al.

(10) Patent No.: US 9,057,525 B2
(45) Date of Patent: Jun. 16, 2015

(54) HOME APPLIANCE WITH UNITARY BAKE ELEMENT RETAINER

(75) Inventors: Ben Braden, Lafollette, TN (US); Charlie Hanna, Knoxville, TN (US); Timothy Russell, Jacksboro, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 254 days.

(21) Appl. No.: 13/472,523

(22) Filed: May 16, 2012

(65) Prior Publication Data

US 2013/0306051 A1 Nov. 21, 2013

(51) Int. Cl.

| | |
|---|---|
| ***A21B 1/00*** | (2006.01) |
| ***A21B 1/02*** | (2006.01) |
| ***F24C 7/06*** | (2006.01) |

(52) U.S. Cl.

CPC ..... *F24C 7/067* (2013.01)

(58) Field of Classification Search

CPC ..... F24C 7/06; F24C 7/062; F24C 7/065
USPC ..... 219/391, 402, 536, 542, 403, 404, 405, 219/408; 29/505, 521, 283.5
See application file for complete search history.

(56) References Cited

U.S. PATENT DOCUMENTS

| | | | | | |
|---|---|---|---|---|---|
| 465,916 | A | * | 12/1891 | Bonnaffon | 256/72 |
| 548,483 | A | * | 10/1895 | Vogel | 24/20 EE |
| 2,790,886 | A | * | 4/1957 | Fry | 219/394 |
| 2,798,930 | A | * | 7/1957 | Frost | 219/392 |
| 2,824,204 | A | * | 2/1958 | Reno et al. | 219/402 |
| 2,854,559 | A | * | 9/1958 | Ammerman | 219/532 |
| 2,875,313 | A | * | 2/1959 | King | 219/520 |
| 2,973,423 | A | * | 2/1961 | Ammerman et al. | 219/404 |
| 2,992,312 | A | * | 7/1961 | Ammerman | 219/532 |
| 3,005,082 | A | * | 10/1961 | Ammerman | 219/537 |
| 3,076,886 | A | * | 2/1963 | Altman et al. | 219/404 |
| 3,161,755 | A | * | 12/1964 | Tilus | 219/403 |
| 3,288,489 | A | * | 11/1966 | Jahn | 403/285 |
| 3,534,466 | A | * | 10/1970 | Ardolino et al. | 29/509 |
| 3,624,741 | A | * | 11/1971 | Dills | 126/19 R |
| 3,719,986 | A | * | 3/1973 | Ardolino et al. | 29/509 |
| 3,875,371 | A | * | 4/1975 | Skinner | 219/404 |
| 4,168,423 | A | * | 9/1979 | Gilreath | 219/402 |
| 4,629,865 | A | * | 12/1986 | Freedman et al. | 219/405 |
| 4,805,592 | A | * | 2/1989 | Enami | 126/273 R |
| 5,678,946 | A | * | 10/1997 | Enami | 403/282 |
| 6,008,478 | A | * | 12/1999 | Crone et al. | 219/402 |
| 6,097,003 | A | * | 8/2000 | Markum et al. | 219/402 |
| 6,359,262 | B1 | * | 3/2002 | Robertson et al. | 219/407 |
| 7,342,203 | B2 | * | 3/2008 | Benoit et al. | 219/402 |
| 8,835,812 | B2 | * | 9/2014 | Braden et al. | 219/406 |
| 2008/0149089 | A1 | * | 6/2008 | Karabin et al. | 126/21 R |

FOREIGN PATENT DOCUMENTS

| | | | |
|---|---|---|---|
| EP | 1030114 | A1 * | 8/2000 |

* cited by examiner

*Primary Examiner* — Dana Ross
*Assistant Examiner* — John J Norton
(74) *Attorney, Agent, or Firm* — James E. Howard; Andre Pallapies

(57) ABSTRACT

A home appliance having an oven with a bake element, the home appliance including an appliance body, an oven cavity defined within the appliance body, a bake element operationally associated within the oven cavity, a bake element retainer supporting the bake element and mounted adjacent the oven cavity, and a mounting arrangement formed integrally with the bake element retainer for mounting the bake element within the oven cavity.

24 Claims, 4 Drawing Sheets

HOME APPLIANCE WITH UNITARY BAKE ELEMENT RETAINER

BACKGROUND OF THE INVENTION

The present invention relates broadly to home appliances having ovens with electric resistive bake elements and, more particularly, to a home appliance, particularly a range, having an improved mounting arrangement for a bake element.

Most every electric range that includes an oven has internal resistive bake elements and broil elements which are generally curved tubular members that produce heat upon electrical activation. The bake elements are mounted under the floor of the oven cavity while the broil elements are mounted to the roof or top wall of the oven cavity. Typically, a retainer will be between the bake element and the bottom of the oven for enhanced heating, due to its reflectivity, and for mounting the bake element under the oven cavity.

In the past, such bake elements have been difficult to install which also means that they are difficult to remove and replace during repair. In the past, the bake element had to be removed with the entire bake assembly. In addition, advances in oven fascias have reduced the available space under the oven door area for inserting and removing the bake element, making it even more difficult to access and remove the bake element. Installation of the bake element was no easier. The old method used brackets that were attached to the retainer with screws that pass into cavity wall that made installation difficult. Further, such mounting brackets could allow warping or deflection of the bake element during heating.

Currently, there is a need for an improved and more secure arrangement to mount the bake element within the oven, below the oven cavity floor.

SUMMARY OF THE INVENTION

The present invention is intended to provide an improved arrangement for mounting a bake element to a bake element retainer and in turn to the oven cavity structure that will make installation and removal a more straightforward operation.

The present invention is also intended to provide such a mounting arrangement that will retain the bake element at specific locations to prevent warping or deflection of the bake element during heating.

The present invention is also intended to provide cost savings by removing the need for separate brackets and wireforms for mounting the bake element within the oven cavity.

To those ends, a home appliance having an oven with a bake element includes an appliance body and an oven cavity defined within the appliance body. A bake element is operationally associated within the oven cavity. A bake element retainer supports the bake element and is mounted adjacent the oven cavity. A mounting arrangement is formed integrally with the bake element retainer for mounting the bake element within the oven cavity.

Preferably, the bake element is formed as a serpentine electrical resistance element, the retainer is formed as a planar sheet and the mounting arrangement includes a plurality of tabs projecting from the planar sheet and engaged with predetermined portions of the bake element.

It is preferred that the bake element is a tubular member and each of the tabs includes a cutout for receiving a tubular portion of the bake element. Preferably, the cutouts are formed with an entry opening and a support surface, wherein the entry opening has one of a u-shape and a c-shape. It is also preferred that a plurality of tabs with u-shaped cutouts are at a front portion of the bake element retainer and a plurality of tabs with c-shaped cutouts are at a rear portion of the bake element retainer. It is preferable that the oven cavity defines a centerline wherein a predetermined number of tabs include cutouts open toward the oven centerline and a predetermined number of tabs include cutouts open away from the oven centerline.

Preferably, the retainer is a planar sheet and the mounting arrangement includes a plurality of tabs in the planar sheet and in a generally perpendicular relationship with the planar sheet, with the tabs projecting from the planar sheet and engaged with predetermined portions of the bake element.

It is further preferred that the oven cavity is defined by a plurality of interconnecting walls, including generally vertical side walls and a generally horizontal bottom wall, the bake element retainer being mounted to the range under the bottom wall, wherein the mounting arrangement includes a plurality of tabs in a planar sheet and extending in a generally perpendicular relationship with the planar sheet, with the tabs projecting generally vertically upwardly from the planar sheet and engaged with predetermined portions of the bake element.

Preferentially, the serpentine bake element includes a plurality of runs joined by a plurality of returns at a plurality of corners and the plurality of tabs are adjacent predetermined corners of the bake element. Further, the serpentine bake element may include a plurality of runs joined by a plurality of returns at a plurality of corners and the plurality of tabs are arranged in a manner wherein a tab is adjacent each of the returns. It is further preferred that the bake element includes eight runs joined by seven returns defining fourteen corners, and wherein the plurality of tabs includes nine tabs adjacent predetermined corners of the bake element, wherein a tab is at a corner adjacent each of the respective returns.

Preferably, the serpentine bake element includes a plurality of runs joined by a plurality of returns at a plurality of corners and the plurality of tabs are adjacent predetermined corners of the bake element. It is further preferred that the bake element includes eight runs joined by seven returns defining fourteen corners, and wherein the plurality of tabs includes nine tabs adjacent predetermined corners of the bake element, wherein a tab is at a corner adjacent each of the respective returns.

The present invention preferably further includes a stop member releaseably mounted to the bake element retainer to both prevent forward motion of the bake element and to reflect heat back toward the bake element during operation.

The present invention is also directed to a range having an oven with a bake element. The present range includes a range body, an oven cavity defined within the range body and a bake element operationally associated within the oven cavity. A bake element retainer supports the bake element and is mounted adjacent the oven cavity. A mounting arrangement is formed integrally with the bake element retainer for mounting the bake element within the oven cavity.

Preferably, the bake element is formed as a serpentine electrical resistance element, the retainer is a planar sheet and the mounting arrangement includes a plurality of tabs projecting from the planar sheet and engaged with predetermined portions of the bake element.

It is preferred that the bake element is a tubular member and each of the tabs includes a cutout for receiving a tubular portion of the bake element. It is further preferred that the cutouts are formed with an entry opening and a support surface, wherein the entry opening has one of a u-shape and a c-shape. In addition, a plurality of tabs with u-shaped cutouts are preferably at a front portion of the bake element retainer and a plurality of tabs with c-shaped cutouts are preferably at a rear portion of the bake element retainer. Preferentially, the oven cavity defines a centerline wherein a predetermined number of tabs include cutouts open toward the oven centerline and a predetermined number of tabs include cutouts open away from the oven centerline.

It is further preferred that the retainer is a planar sheet and the mounting arrangement includes a plurality of tabs in the planar sheet and in a generally perpendicular relationship with the planar sheet, with the tabs projecting from the planar sheet and engaged with predetermined portions of the bake element.

Preferably, the oven cavity is defined by a plurality of interconnecting walls, including generally vertical side walls and a generally horizontal bottom wall, the bake element retainer being mounted to the range under the bottom wall, wherein the mounting arrangement includes a plurality of tabs in a planar metal sheet and extending in a generally perpendicular relationship with the planar sheet, with the tabs projecting generally vertically upwardly from the planar sheet and engaged with predetermined portions of the bake element.

It is preferred that the serpentine bake element includes a plurality of runs joined by a plurality of returns at a plurality of corners and the plurality of tabs are adjacent predetermined corners of the bake element. Preferably the serpentine bake element includes a plurality of runs joined by a plurality of returns at a plurality of corners and the plurality of tabs are arranged in a manner wherein a tab is adjacent each of the returns. Further, the bake element may include eight runs joined by seven returns defining fourteen corners, and the plurality of tabs may include nine tabs adjacent predetermined corners of the bake element, wherein a tab is at a corner adjacent each of the respective returns.

It is further preferred that the serpentine bake element includes a plurality of runs joined by a plurality of returns at a plurality of corners and the plurality of tabs are adjacent predetermined corners of the bake element. Preferably, the bake element includes eight runs joined by seven returns defining fourteen corners, and wherein the plurality of tabs includes nine tabs adjacent predetermined corners of the bake element, wherein a tab is at a corner adjacent each of the respective returns.

The present invention preferably further includes a stop member releaseably mounted to the bake element retainer to both prevent forward motion of the bake element and to reflect heat back toward the bake element during operation.

DESCRIPTION OF THE PREFERRED EMBODIMENT

Figure 1:
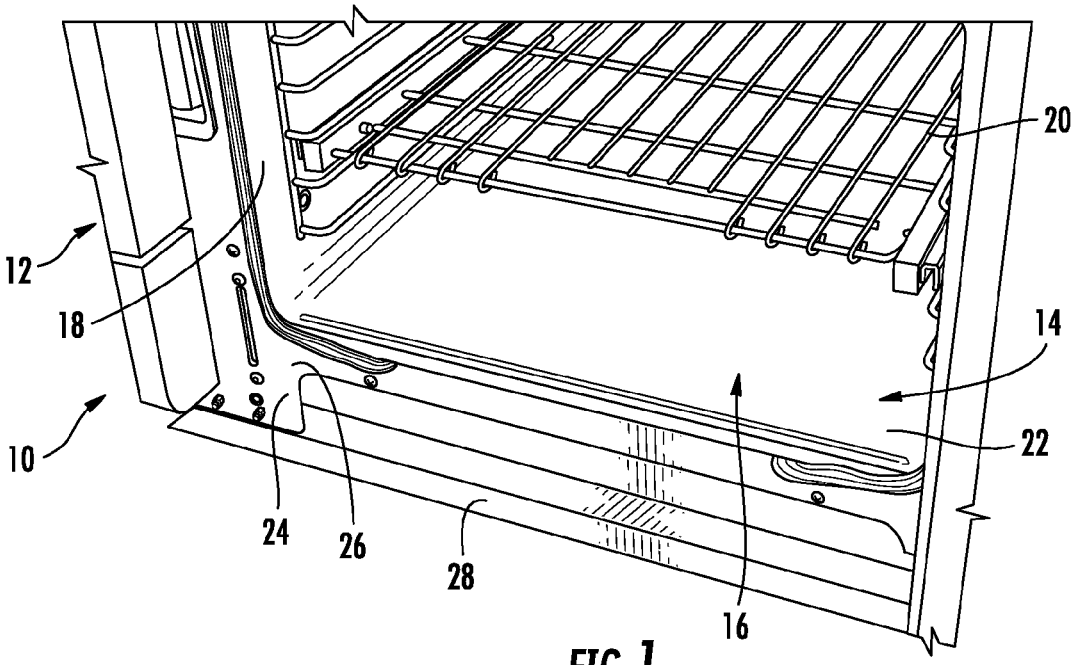
FIG. 1 is a perspective view of the oven cavity of a home appliance according to the preferred embodiment of the present invention.
Figure 2:
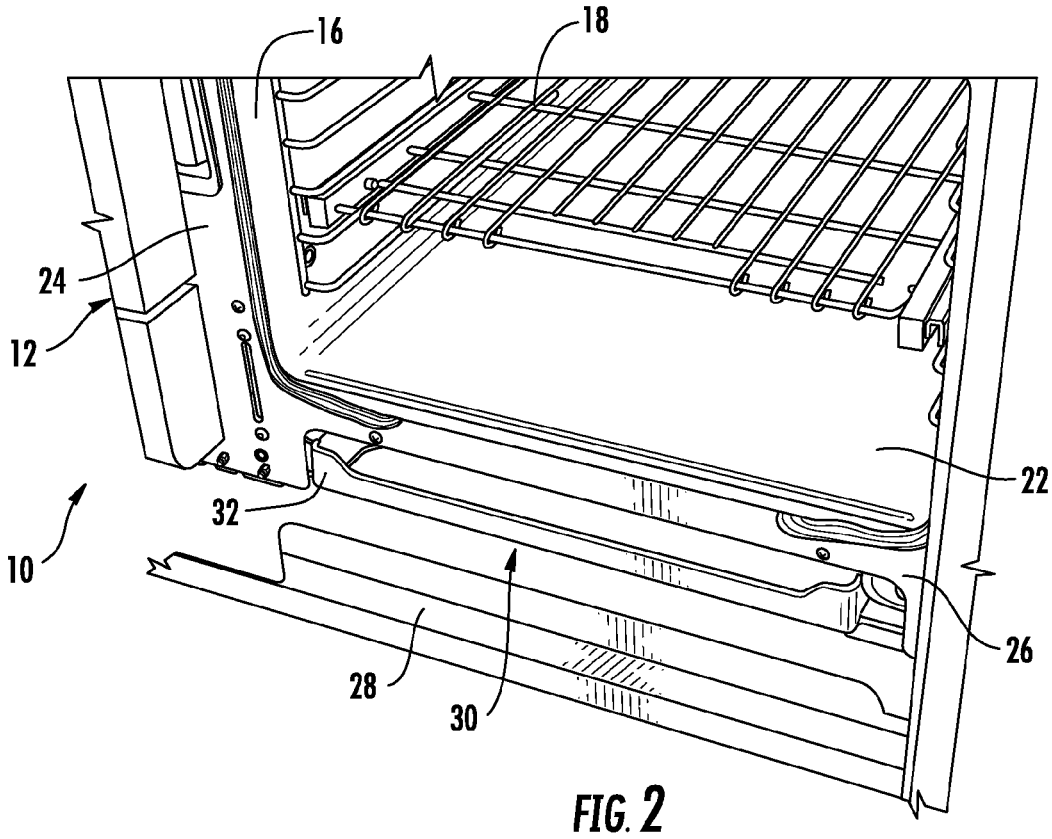
FIG. 2 is a front perspective view of the front appliance illustrated in FIG. 1 with a lower cover plate removed.

Turning now to the drawings and more particularly to FIG. 1 and FIG. 2, a range is illustrated generally at 10 and includes a floor-standing, box-like range body 12 defining an oven 14. The lower portion of the range body 12 is illustrated to focus on the bake element retainer of the present invention. The oven 14 is open to the atmosphere through an access opening 16. The oven cavity is defined in the range body 12 by side walls 18, a floor 22, a back wall (not shown) and a roof (not shown). A rack 20 is mounted to the side walls 18 and extends traversely across the oven 14 for food support during cooking. A generally planar fascia 24 attached to the front of the oven 14 is a metal sheet having various opening and shapes to provide a covering for the skeletal frame 32 of the oven 14.

A lower panel 28 is sculpted from a planar sheet to cover a lower opening 30 in the fascia 24 to allow access under the floor 22 where the bake element 34 is mounted. The lower bake element access 30 is defined by a curved opening in the fascia 24 having smoothly turned corners 26. These corners 26 make it more difficult to remove anything from under the floor 22 of the oven 14. The present invention seeks to accommodate such corners 26 by reducing the amount of range structure necessary for insertion or removal during installation or removal of the bake element 34.

Figure 4:
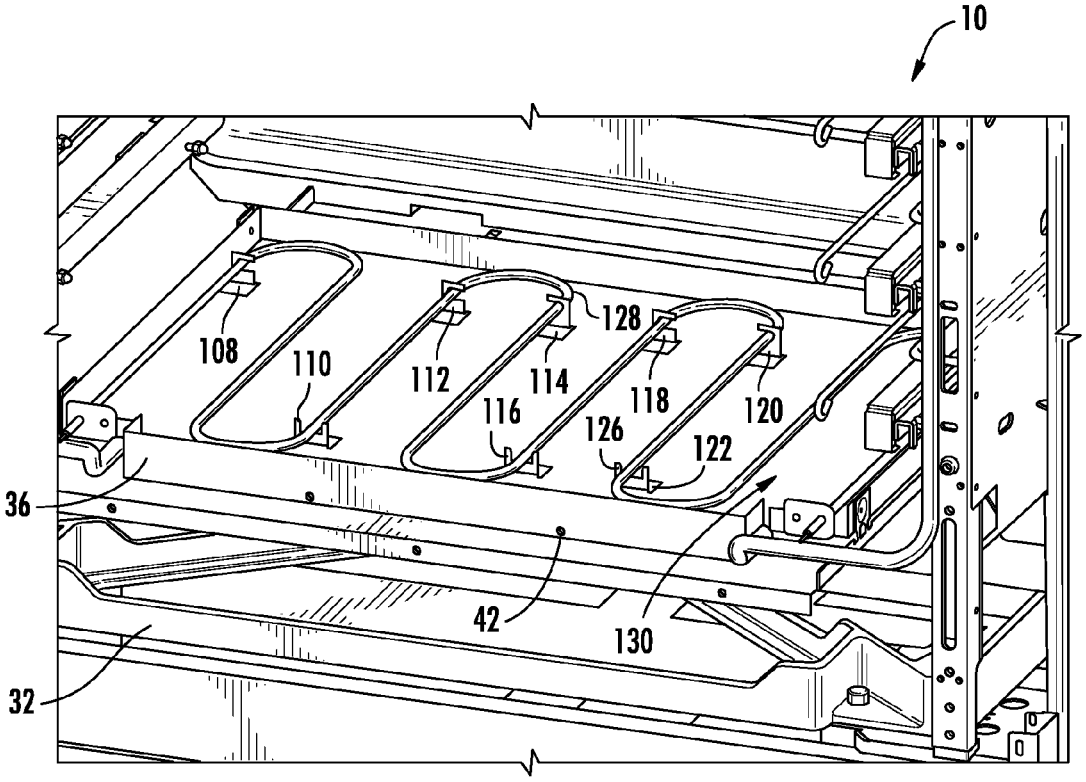
FIG. 4 is a perspective view of the oven illustrated in FIG. 3 with the front fascia of the oven removed.

In the past, the entire bake element assembly 130, as seen in FIG. 4, had to be removed through the area available under the floor 22 and between the frame 32 and fascia 24 for working access to the bake element 34.

Figure 3:
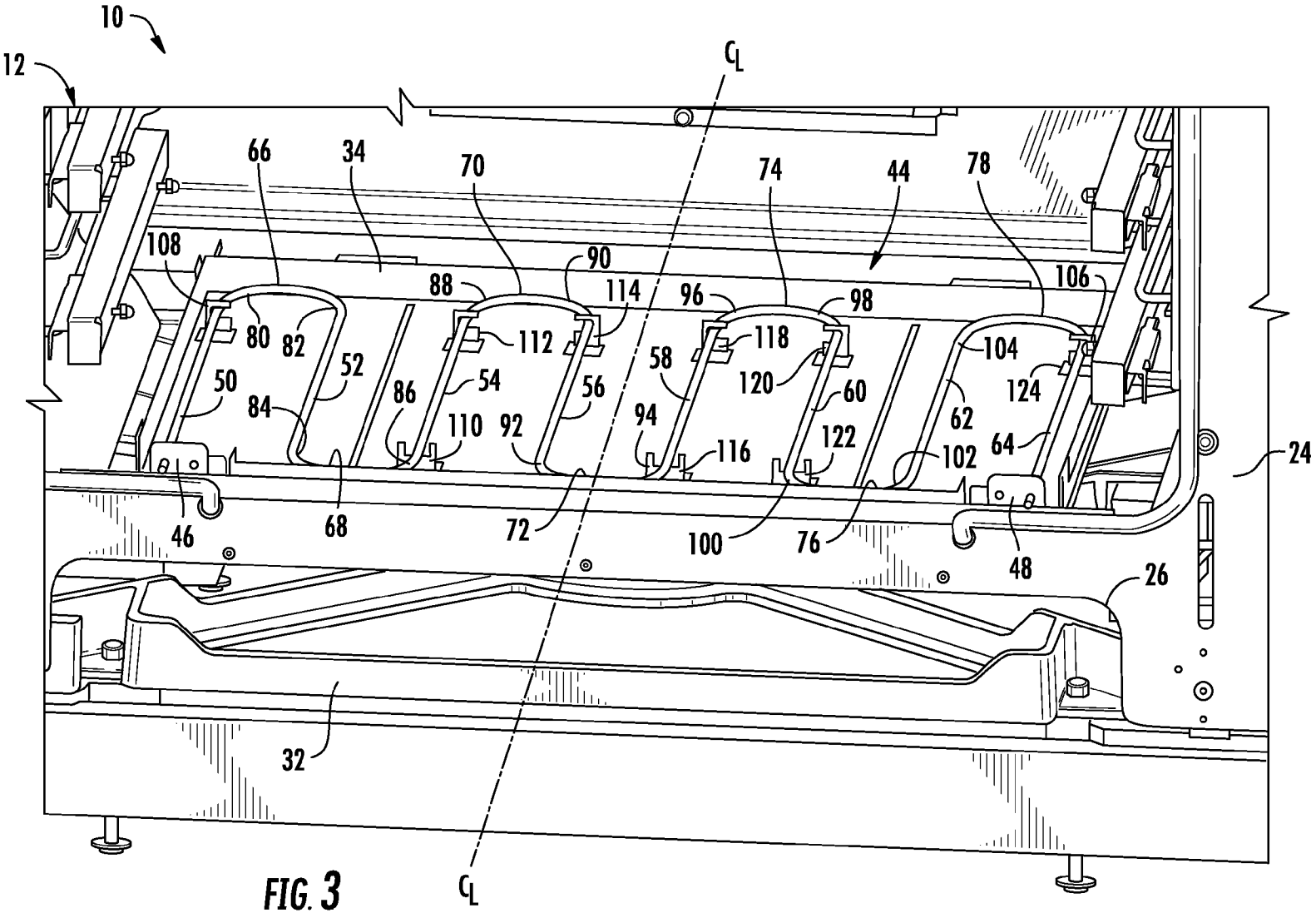
FIG. 3 is a perspective view of the bake element mounted in an oven cavity according to the preferred embodiment of the present invention.

Turning now to FIG. 3, the bake element 44 is plugged into the front wall (not shown) of the oven 14 at a first electrical connector 46 on one end and a second electrical connector 48 on the other. The bake element 44 is a tubular member formed into a serpentine or boustrophedonic configuration having a series of runs and returns joined by corners. The "returns" are the generally U-shaped portions of the tubular element extending from the runs and joining one run to the next. The runs and returns are joined at a plurality of corners. There are eight linear runs, and seven returns defining a serpentine structure. As will be seen, tabs are provided at specific, predetermined locations to support the bake element 44 in a manner that will resist twisting and warping when the resistive bake element 44 is heated to operational temperature.

Proceeding from left to right in FIG. 3, a first linear run 50 extends from the left electrical connector 46 from front to back and is joined to a first return 66 at a first corner 80. The first return 66 curves the bake element 44 back into a second run 52 that extends from a second corner 82, back to front, to a third corner 84 adjacent the front wall (not shown) of the oven 14. A second return 68 extends from the third corner 84 at the second run 52 to a fourth corner 86 wherein the bake element 44 is turned to extend from front to back through the third run 54. A third return 70 joins the third run 54 at a fifth corner 88 and bends the bake element 44 to a sixth corner 90 where it is reversed and attaches to the fourth run 56 to extend from back to front. The fourth run 56 ends at a seventh corner 92 and bends into the fourth return 72 that goes through the centerline CL of the oven. As will be seen, the remaining portion of bake element 44 is a minor image of the first portion.

From the centerline CL, the fourth return 72 extends to the eighth corner 94 where it once again turns to extend from front to back through the fifth run 58. The fifth run 58 ends at the ninth corner 96 and the bake element 44 extends through the fifth return 74 to the tenth corner 98. From there, the bake element 44 extends from back to front through the sixth run 60 ending at the eleventh corner 100 where the sixth return 76 extends to the twelfth corner 102. From the twelfth corner 102, the seventh run 62 extends from front to back ending at the thirteenth corner 104. The seventh and final return 78 extends from the thirteenth corner 104 to the fourteenth corner 106 to reverse direction of the bake element 44 to again extend from back to front along the eighth run 64 to the second electrical connector 48.

Figure 5:
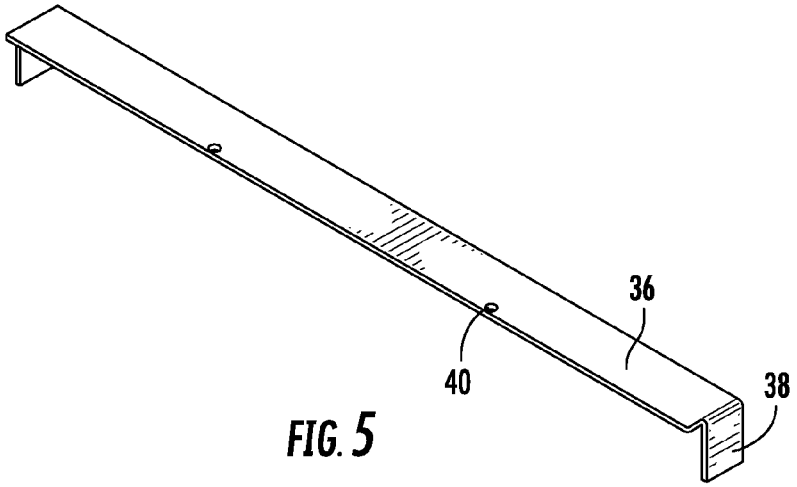
FIG. 5 is a perspective view of the stop member according to the preferred embodiment of the present invention.
Figure 6:
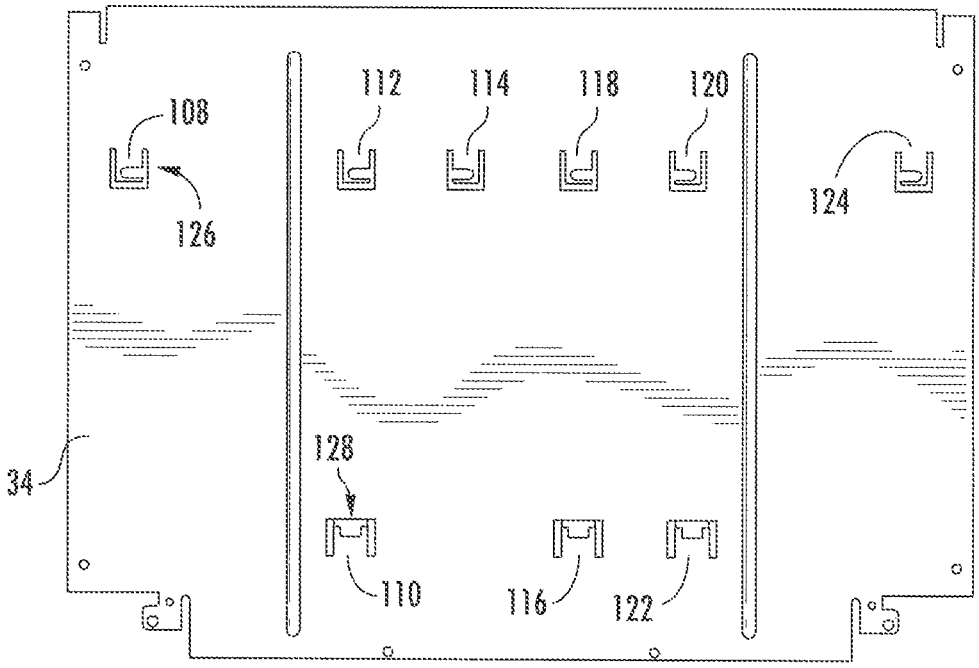
FIG. 6 is a perspective view of the bake element retainer according to the preferred embodiment of the present invention.
Figure 7:
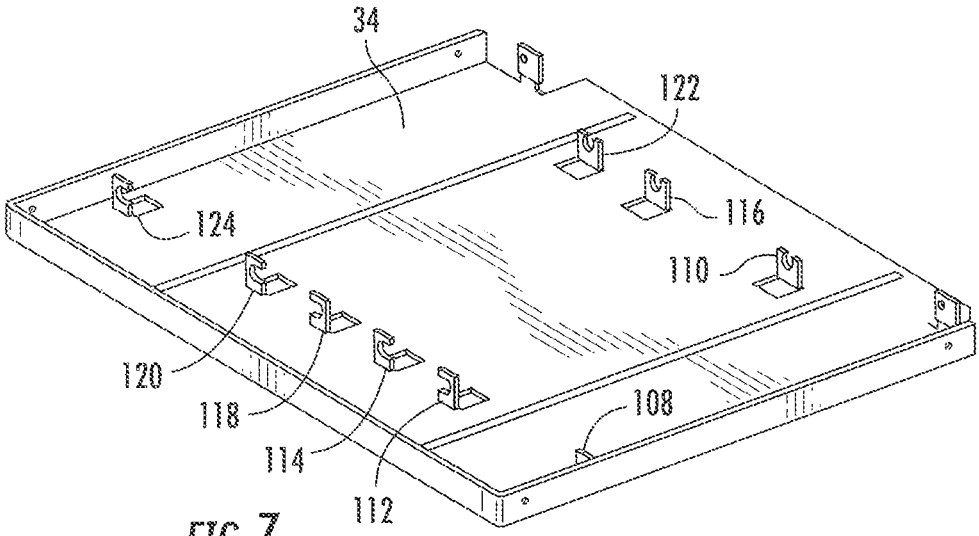
FIG. 7 is a top plan view of the bake element retainer illustrated in FIG. 6 during manufacture.

A plurality of tabs project outwardly from the retainer 34 to support the tubular bake element 44. As seen in FIGS. 3, 4 and 5, each tab 108, 110, 112, 114, 116, 118, 120, 122, 124 is a generally rectangular member having a cutout to receive a portion of the tubular bake element 44. As seen in FIG. 6 and FIG. 7, the tabs are cut from a sheet of metal which becomes the retainer 34. Each tab has the same structure, except for the cutouts, so explanation of one tab will explain the entire set of seven tabs. For example, and with reference to FIG. 6, each tab is a generally rectangular member having either a U-shaped cutout 126 or a C-Shaped cutout 128 each cutout leading to a support surface. As seen in FIG. 6, each of the tabs is cut into the sheet metal and, as seen in FIG. 7, each of the tabs is bent upwardly to a generally 90° angle with the planar sheet to define the respective tab.

Returning to FIG. 3, and extending from left to right, a first tab 108 is at the first corner 80 with a C-shaped cutout 128 facing the centerline CL of the oven 14. A second tab 110 is at the fourth corner 86 with a U-shaped cutout 126. A third tab 112 is at the fifth corner 88 with a C-shaped cutout 128 facing the centerline CL of the oven 14. While the tabs are discussed as being at the corners, the tabs are adjacent the corners and support a portion of a run rather than a corner of the tubular bake element 44.

A fourth tab 114 is at the sixth corner 90 with a C-shaped cutout 128 facing away from the centerline CL of the oven 14. A fifth tab 116 is adjacent the eighth corner 94 with a U-shaped cutout 126. A sixth tab 118 is at the ninth corner 96 with a C-shaped cutout 128 facing away from the centerline CL of the oven 14. A seventh tab 120 is adjacent the tenth corner 98 with a C-shaped cutout 128 facing the centerline CL of the oven 14. An eighth tab 122 is adjacent the eleventh corner 100 and has a U-shaped cutout 126. The ninth and final tab 124 is adjacent the fourteenth corner 106 and has a C-shaped cutout 128 facing the centerline CL of the oven 14.

Based on the foregoing, it can be seen that the bake element 44 is supported at nine different places with tabs that include U-shaped cutouts 124 near the front of the oven 14 and tabs that include C-shaped cutouts 128 near the rear of the oven 14, as seen in FIG. 3. Since there are seven returns and nine tabs, no return is left unsupported and, as such, the present mounting arrangement enhances the stability of the bake element 44. Accordingly, the bake element 44 will resist warping or deflection during heating because the present tabs allow for more free expansion of the bake element 44 than did the prior mounting structure.

FIG. 4 illustrates the oven 14 without the fascia thereon and more precisely discloses the stop member 36 illustrated in FIG. 5. The stop member 36 includes a generally elongate planar structure having two small inturned side walls 38 projecting away from the planar body of the stop member 36. Two openings 40 are provided for screws 42 or other fasteners to extend therethrough to mount the stop member 36 to the retainer 34 for ease of removal once the lower cover panel 28 is removed as seen in FIG. 1 and FIG. 2. The stop member 36 both restrains the bake element 44 from sliding forward and reflects heat onto the bottom of the oven cavity.

By the above, the present invention provides an improved and simplified mounting arrangement for a bake element in an oven that is more cost-effective to produce and enhances the structural strength and rigidity of the bake element.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance having an oven with a bake element, the home appliance comprising:
- an appliance body;
- an oven cavity defined within the appliance body;
- a bake element operationally associated within the oven cavity;
- a bake element retainer supporting the bake element and mounted adjacent the oven cavity, the bake element retainer being a planar sheet; and
- a mounting arrangement formed integrally with the bake element retainer for mounting and supporting the bake element within the oven cavity, the mounting arrangement including a plurality of tabs formed in the planar sheet and projecting outwardly therefrom, wherein a first plurality of tabs each have a u-shaped cutout having an access opening configured for vertically oriented access by the bake element and being disposed at a front portion of the bake element retainer and a second plurality of tabs each have a c-shaped cutout having an access opening configured for horizontally oriented access by the bake element and being disposed at a rear portion of the bake element retainer wherein the bake element is supported by the tabs with a portion of the bake element fitted into the cutouts in the first plurality of tabs and a portion of the bake element fitted into the cutouts in the second plurality of tabs, wherein a portion of the tabs having c-shaped cutouts have openings directed toward one another.

2. The home appliance of claim 1 wherein the bake element is a tubular member and each of the tabs supports a tubular portion of the bake element.

3. The home appliance of claim 2 wherein the cutouts are formed with an entry opening and a support surface, wherein the entry opening has one of a u-shape and a c-shape.

4. The home appliance of claim 2 wherein the oven cavity defines a centerline wherein a predetermined number of tabs include c-shaped cutouts open toward the oven centerline and a predetermined number of tabs include c-shaped cutouts open away from the oven centerline.

5. The home appliance of claim 1 wherein the retainer is formed as a planar sheet and the mounting arrangement includes a plurality of tabs in the planar sheet and in a generally perpendicular relationship with the planar sheet, with the tabs projecting from the planar sheet and engaged with predetermined portions of the bake element.

6. The home appliance of claim 1 wherein the oven cavity is defined by a plurality of interconnecting walls, including generally vertical side walls and a generally horizontal bottom wall, the bake element retainer being mounted to the range under the bottom wall, wherein the mounting arrangement includes a plurality of tabs in a planar metal sheet and extending in a generally perpendicular relationship with the planar sheet, with the tabs projecting generally vertically upwardly from the planar sheet and engaged with predetermined portions of the bake element.

7. The home appliance of claim 6 wherein the bake element includes a plurality of runs joined by a plurality of returns at a plurality of corners and the plurality of tabs are adjacent predetermined corners of the bake element.

8. The home appliance of claim 5 wherein the bake element includes a plurality of runs joined by a plurality of returns at a plurality of corners and the plurality of tabs are arranged in a manner wherein at least one of the plurality of tabs is adjacent each of the returns.

9. The home appliance of claim 5 wherein the bake element includes eight runs joined by seven returns defining fourteen corners, and wherein the plurality of tabs includes nine tabs adjacent predetermined corners of the bake element, wherein at least one of the plurality of tabs is at a corner adjacent respective returns.

10. The home appliance of claim 1 wherein the bake element includes a plurality of runs joined by a plurality of returns at a plurality of corners and the plurality of tabs are adjacent predetermined corners of the bake element.

11. The home appliance of claim 10 wherein the bake element includes eight runs joined by seven returns defining fourteen corners, and wherein the plurality of tabs includes nine tabs adjacent predetermined corners of the bake element, wherein at least one of the plurality of tabs is at a corner adjacent respective returns.

12. The home appliance of claim 1 and further comprising a stop member forming an appliance body panel member and releaseably mounted to the bake element retainer to provide user access to the bake element, to prevent forward motion of the bake element and to reflect heat back toward the bake element during operation.

13. A range having an oven with a bake element, the range comprising:

a range body;

an oven cavity defined within the range body;

a bake element operationally associated within the oven cavity;

a bake element retainer supporting the bake element and mounted adjacent the oven cavity, the bake element retainer being a planar sheet; and a mounting arrangement formed integrally with the bake element retainer for mounting and supporting the bake element within the oven cavity, the mounting arrangement including a plurality of tabs formed in the planar sheet and projecting outwardly therefrom, wherein a first plurality of tabs each have a u-shaped cutout having an access opening configured for vertically oriented access by the bake element and being disposed at a front portion of the bake element retainer and a second plurality of tabs each have a c-shaped cutout having an access opening configured for horizontally oriented access by the bake element and being disposed at a rear portion of the bake element retainer wherein the bake element is supported by the tabs with a portion of the bake element fitted into the cutouts in the first plurality of tabs and a portion of the bake element fitted into the cutouts in the second plurality of tabs, wherein a portion of the tabs having c-shaped cutouts have openings directed toward one another.

14. The range of claim 13 wherein the bake element is a tubular member and the plurality of tabs supports a tubular portion of the bake element.

15. The range of claim 14 wherein the cutouts are formed with an entry opening and a support surface, wherein the entry opening has one of a u-shape and a c-shape.

16. The range of claim 14 wherein the oven cavity defines a centerline wherein a predetermined number of tabs include c-shaped cutouts open toward the oven centerline and a predetermined number of tabs include c-shaped cutouts open away from the oven centerline.

17. The range of claim 13 wherein the retainer is formed as a planar sheet and the mounting arrangement includes a plurality of tabs in the planar sheet and in a generally perpendicular relationship with the planar sheet, with the tabs projecting from the planar sheet and engaged with predetermined portions of the bake element.

18. The range of claim 13 wherein the oven cavity is defined by a plurality of interconnecting walls, including generally vertical side walls and a generally horizontal bottom wall, the bake element retainer being mounted to the range under the bottom wall, wherein the mounting arrangement includes a plurality of tabs in a planar metal sheet and extending in a generally perpendicular relationship with the planar sheet, with the tabs projecting generally vertically upwardly from the planar sheet and engaged with predetermined portions of the bake element.

19. The range of claim 18 wherein the bake element includes a plurality of runs joined by a plurality of returns at a plurality of corners and the plurality of tabs are adjacent predetermined corners of the bake element.

20. The range of claim 17 wherein the bake element includes a plurality of runs joined by a plurality of returns at a plurality of corners and the plurality of tabs are arranged in a manner wherein at least one of the plurality of tabs is adjacent each of the returns.

21. The range of claim 17 wherein the bake element includes eight runs joined by seven returns defining fourteen corners, and wherein the plurality of tabs includes nine tabs adjacent predetermined corners of the bake element, wherein at least one of the plurality of tabs is at a corner adjacent respective returns.

22. The range of claim 13 wherein the serpentine bake element includes a plurality of runs joined by a plurality of returns at a plurality of corners and the plurality of tabs are adjacent predetermined corners of the bake element.

23. The range of claim 22 wherein the bake element includes eight runs joined by seven returns defining fourteen corners, and wherein the plurality of tabs includes nine tabs adjacent predetermined corners of the bake element, wherein at least one of the plurality of tabs is at a corner adjacent respective returns.

24. The range of claim 13 and further comprising a stop member forming a range body panel member and releaseably mounted to the bake element retainer to provide user access to the bake element, to prevent forward motion of the bake element and to reflect heat back toward the bake element during operation.

* * * * *